US005119056A

United States Patent [19]

Itoh et al.

[11] Patent Number: 5,119,056

[45] Date of Patent: Jun. 2, 1992

[54] PROJECTION YOKE WITH AUXILIARY DEFLECTION YOKE ATTACHMENT

[75] Inventors: Keiji Itoh; Mamoru Motokura, both of Osaka, Japan

[73] Assignee: Sanyo Electric Co., Ltd., Osaka, Japan

[21] Appl. No.: 645,057

[22] Filed: Jan. 24, 1991

[30] Foreign Application Priority Data

Jan. 30, 1990 [JP] Japan ..... 2-19554

[51] Int. Cl.[5] ..... H01J 29/70; H01H 1/00

[52] U.S. Cl. ..... 335/213; 335/210; 313/440

[58] Field of Search ..... 335/210-213; 313/440

[56] References Cited

U.S. PATENT DOCUMENTS 3,573,525 4/1971 Fuse ..... 335/210

4,754,248 6/1988 Belica ..... 335/213

FOREIGN PATENT DOCUMENTS 63-95160 6/1988 Japan .

*Primary Examiner*—Leo P. Picard
*Assistant Examiner*—Romon M. Barrera
*Attorney, Agent, or Firm*—Heller, Ehrman, White, McAuliffe

[57] ABSTRACT

A projection yoke has a main deflection yoke with main vertical and horizontal coils wound on a coil separator and an auxiliary deflection yoke attached to a back surface of the coil separator. The auxiliary deflection yoke has pairs of auxiliary vertical and horizontal deflection coils wound toroidally on an annular core, the coils of each pair being opposite from each other with respect to the annular core and the two pairs being perpendicular to each other.

4 Claims, 3 Drawing Sheets

PROJECTION YOKE WITH AUXILIARY DEFLECTION YOKE ATTACHMENT

BACKGROUND OF THE INVENTION

This invention relates to a projection yoke for a color projection TV of the type having electron guns corresponding to three primary colors.

In general, a projection TV of this type includes three electron guns (beam projection tubes) disposed at different places and an optical system is utilized to project a large image on a screen. For this reason, it is essential to completely eliminate any drift of rasters from the individual tubes such that the three color images are perfectly matched on the screen. In order to accomplish this purpose, a projection yoke for such a use includes not only a main deflection yoke but also an auxiliary yoke (or a convergence yoke) for correcting dynamic convergence as shown, for example, in Japanese Utility Model Publication Jikkai 63-95160.

With reference now to FIG. 7 which shows a prior art projection yoke, numeral 21 indicates a main deflection yoke with a coil separator 22 to which a main vertical deflection coil 21*a* and a main horizontal deflection coil 21*b* are attached through a core 21*c*. An auxiliary deflection yoke 23 is attached to an enlarged back part 22*a* of this coil separator 22 by screws. Numeral 24 indicates a ring core to which auxiliary vertical and horizontal deflection coils are attached and, as shown in FIG. 8, has four protrusions 24*a* in its interior. The auxiliary vertical and horizontal deflection coils on bobbins 25 are adapted to be set thereonto. Because of these bobbins 25, however, the auxiliary deflection yoke 23 tends to be big, causing an increase in the cost as a whole.

With the structure as shown in FIG. 8, furthermore, the resultant magnetic field tends to be excessively barrel-shaped, adversely affecting the quality of the electron beams.

SUMMARY OF THE INVENTION

It is therefore an object of the present invention to provide an improved projection yoke which can be made compact.

It is another object of the invention to provide a projection yoke for a projection TV having improved characteristics.

The above and other objects of the present invention can be achieved by providing a projection yoke which has a main deflection yoke with main vertical and horizontal coils wound on a coil separator and an auxiliary deflection yoke attached to a back surface of the coil separator and is further characterized in that the auxiliary deflection yoke has pairs of auxiliary vertical and horizontal deflection coils wound toroidally on a unistructural annular core without partitions. With the auxiliary deflection coils thus wound toroidally on such an annular core, leak magnetic fields operate effectively to improve the deflection sensitivity and other performance characteristics and since no bobbins or core clamps are required, the overall cost can be reduced.

BRIEF DESCRIPTION OF THE DRAWINGS

The accompanying drawings, which are incorporated in and form a part of the specification, illustrate embodiments of the present invention and serve to explain the principles of the invention. In the drawings.

DETAILED DESCRIPTION OF THE INVENTION

Figure 1:
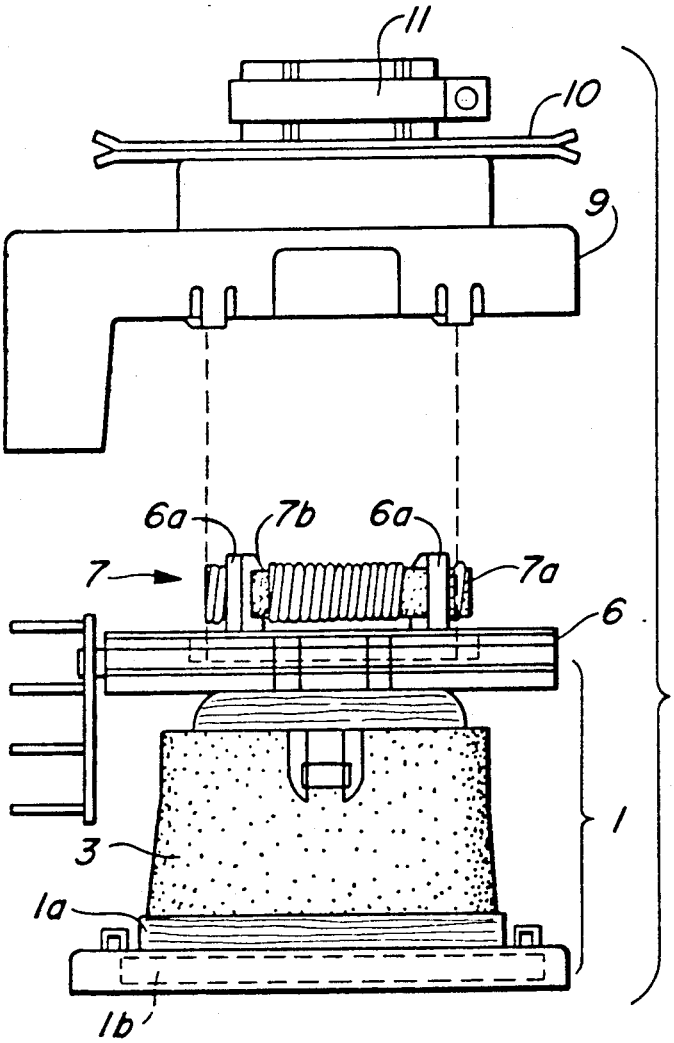
FIG. 1 is a side view of a projection yoke embodying the present invention.
Figure 2:
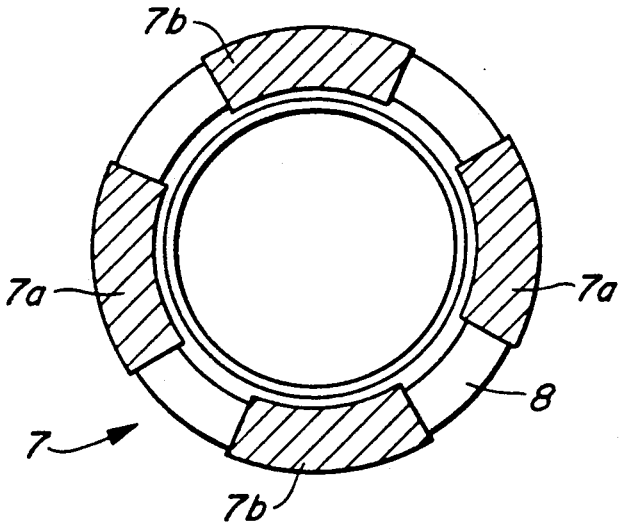
FIG. 2 is a plan view of the auxiliary deflection coils of FIG. 1.
Figure 7:
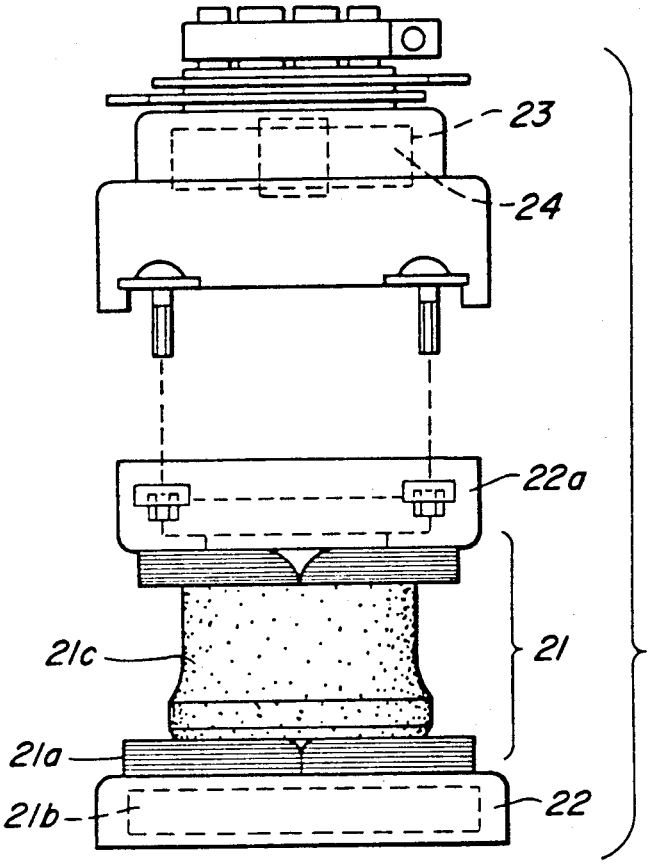
FIG. 7 (PRIOR ART)
FIG. 7 is a side view of a prior art projection yoke.
Figure 8:
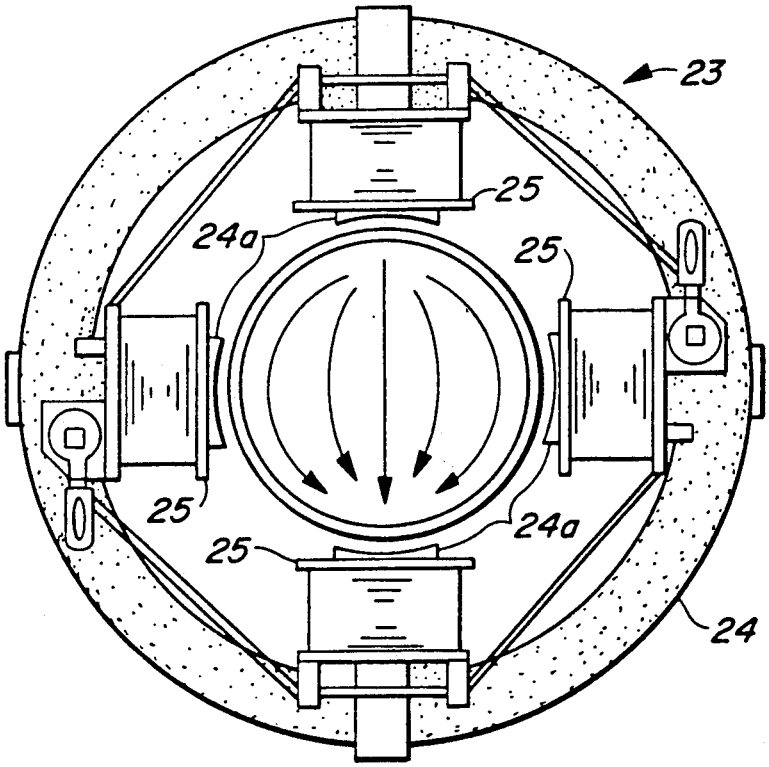
FIG. 8 (PRIOR ART)
FIG. 8 is a plan view of a prior art auxiliary deflection coils.

With reference to FIG. 1 which shows a projection yoke embodying the present invention, a main deflection yoke 1 is comprised of a coil separator 6 and a core 3 supporting a main vertical deflection coil 1*a* and a main horizontal deflection coil 1*b* as described above in connection with FIG. 7. The coil separator 6 has an enlarged back part to which is attached an auxiliary deflection yoke (or convergence yoke) 7. As shown more clearly in FIG. 2, the auxiliary deflection yoke 7 is comprised of a non-partitioned (unistructural) ferrite ring core 8 on which a pair of auxiliary vertical coils 7*a* and a pair of auxiliary horizontal coils 7*b* are toroidally wound, each pair of coils 7*a* and 7*b* being mutually opposite from each other (that is, mutually displaced by 180° around the ring core 8). The ring core 8 itself is supported by tongue-shaped elastic pieces 6*a*. In order to prevent the ringing effects of the image due to the interference with the horizontal deflection coil 1*b* of the main deflection yoke 1, the auxiliary deflection yoke 7 is separated from the enlarged back part of the coil separator 6 by 5–8 mm. In FIG. 1, numeral 9 indicates a cover which is provided with a centering magnet 10 and a yoke clamp 11 and is adapted to engage with the enlarged back part of the coil separator 6.

Figure 4:
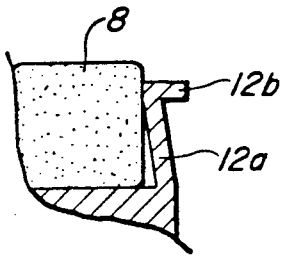
FIG. 4 is an enlarged sectional view of a tongue-shaped piece shown in FIG. 3.
Figure 3:
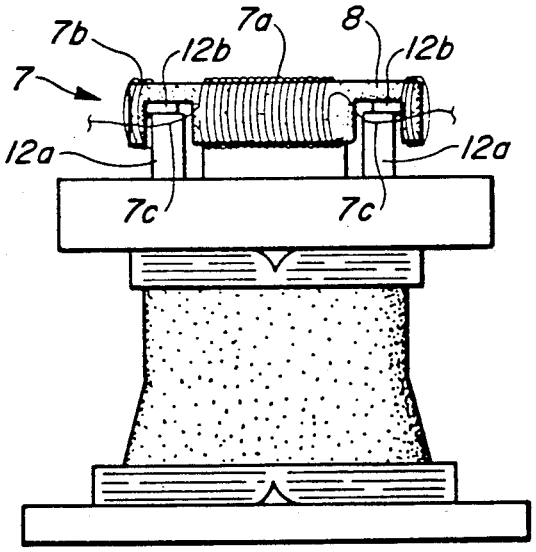
FIG. 3 is a side view of another projection yoke embodying the present invention.

FIG. 3 shows another projection yoke embodying the present invention, characterized in that the auxiliary deflection yoke 7 is supported by tongue-shaped elastic pieces 12*a* having rib-like end structures 12*b* for passing lead lines 7*c* of the coils 7*a* and 7*b* thereunder. As shown more in detail in FIG. 4, the end parts of these tongue-shaped pieces 12*a* bend inwardly near the rib-like end structures 12*b* so as to be able to absorb the dimensional tolerance of the outer diameter of the ring core 8.

Figure 5:
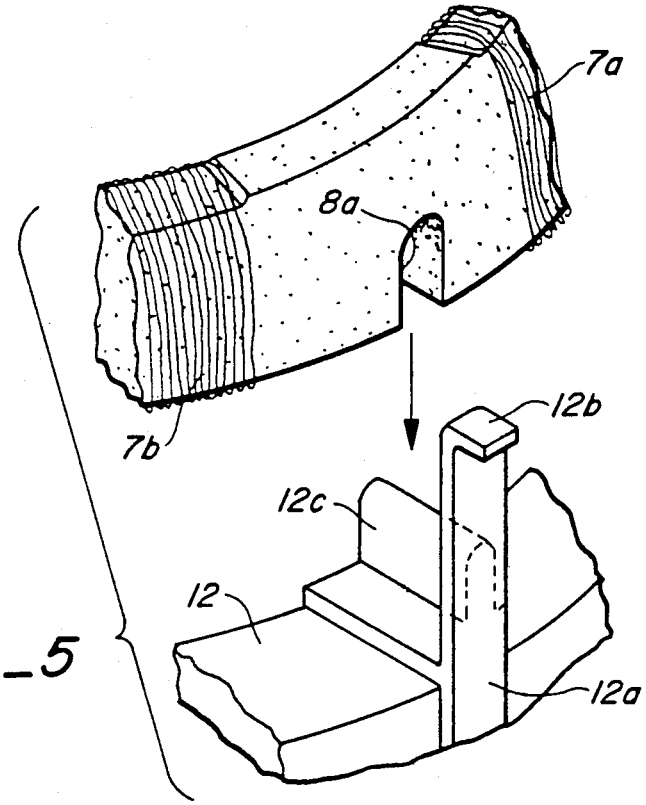
FIG. 5 is a diagonal view of a portion of the auxiliary deflection yoke of FIG. 3.
Figure 6:
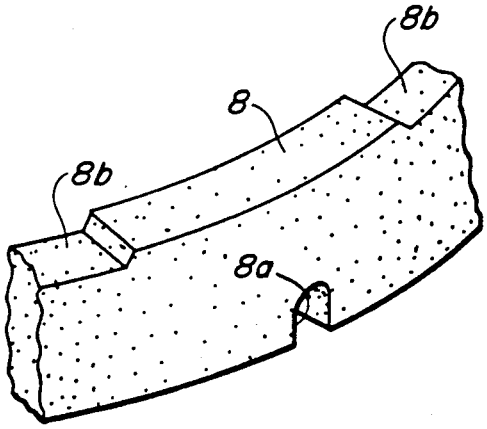
FIG. 6 is a diagonal view of a portion of the ring core according to the present invention.

Although not shown in FIG. 3, protrusions 12*c* are formed as shown in FIG. 5 on the enlarged back part of the coil separator 12 and the ring core 8 is formed with grooves 8*a* at corresponding positions such that rotary motion of the ring core 8 with respect to the coil separator 12 is prevented. The ring core 8 is also made thinner at positions 8*b* where coils 7*a* and 7*b* are wound as shown more clearly in FIG. 6. Steps are thereby created so as to prevent the wound coils 7*a* and 7*b* from becoming disheveled.

The foregoing description of preferred embodiments of the invention has been presented for purposes of illustration and description. It is not intended to be exhaustive or to limit the invention to the precise form disclosed, and many modifications and variations are possible in light of the above teaching. The advantages which can be gained by the present invention includes the following: (1) Since the auxiliary deflection coils are wound toroidally on a ring core which is not partitioned (but is unistructural), leak magnetic fields operate effectively to improve the deflection sensitivity; (2) Since the ring core has no surface-to-surface joints, the magnetic field is not deformed but is substantially uniform, thereby causing no adverse effects on the electron beam and improving focus characteristics; (3) Since the ring core is unistructural, there is no problem of unmatched surfaces or imperfect surface-to-surface contacts and its quality improves as a whole; and (4) Since no bobbins or core clamps are required, the overall cost can be reduced.

Any modifications and variations from the above disclosure that may be apparent to persons skilled in the art are intended to be included within the scope of this invention.

What is claimed is:

1. A projection yoke comprising a main deflection yoke with main vertical and horizontal coils wound on a coil separator having a back surface, an auxiliary deflection yoke being attached to said back surface and having an annular core, a pair of auxiliary vertical defection coils and a pair of auxiliary horizontal deflection coils, said pair of auxiliary vertical deflection coils being toroidally wound on said annular core and mutually separated by 180° with respect to said annular core, said pair of auxiliary horizontal deflection coils being toroidally wound on said annular core and mutually separated by 180° with respect to said annular core, said pair of auxiliary vertical deflection coils and said pair of auxiliary horizontal deflection coils being disposed perpendicularly with respect to each other, and a plurality of elastic tongue-shaped pieces which are attached to said back surface and support said auxiliary deflection yoke, said tongue-shaped pieces having end sections distal from said back surface and bending at said end sections inwardly towards one another so as to contact outer peripheral surface of said annular core, said tongue-shaped pieces also having rib-like end structures at said end sections, said rib-like structures serving to pass lead wires of said coils.

2. The projection yoke of claim 1 wherein said annular core has steps between wound parts where said pairs of coils are wound and unwound parts where said pairs of coils are not wound.

3. The projection yoke of claim 1 wherein said annular core is unistructurally formed.

4. The projection yoke of claim 1 wherein said annular core has grooves and said back surface is formed with protrusions engaging said grooves such that said annular core is prevented from rotating with respect to said coil separator.

* * * * *